US006126148A

United States Patent [19]

Lesenskyj

[11] Patent Number: 6,126,148

[45] Date of Patent: Oct. 3, 2000

[54] METHOD AND APPARATUS FOR FORMING RAILING SECTIONS

[75] Inventor: Anthony Lesenskyj, Lawrenceville, N.J.

[73] Assignee: LMT Products Incorporated, Lawrenceville, N.J.

[21] Appl. No.: 09/185,046

[22] Filed: Nov. 3, 1998

[51] Int. Cl.[7] ..... E04H 17/14

[52] U.S. Cl. ..... 256/65; 256/19; 256/66

[58] Field of Search ..... 256/19, 21, 22, 256/59, 65, 66

[56] References Cited

U.S. PATENT DOCUMENTS

| | | | |
|---|---|---|---|
| 2,150,651 | 3/1939 | Ewing | 256/22 X |
| 3,756,567 | 9/1973 | Murdock | 256/21 |
| 3,955,799 | 5/1976 | Lauzier | 256/21 |
| 4,014,520 | 3/1977 | Walters | 256/22 |
| 4,053,140 | 10/1977 | Clemens et al. | 256/19 |
| 4,188,019 | 2/1980 | Meredith | 256/24 |
| 4,363,467 | 12/1982 | Bos | 256/68 |
| 4,809,955 | 3/1989 | Veilleux | 256/65 |
| 4,892,292 | 1/1990 | Russell | 256/66 |
| 5,613,664 | 3/1997 | Svalbe | 256/19 |
| 5,702,090 | 12/1997 | Edgman | 256/19 |

FOREIGN PATENT DOCUMENTS

| | | | |
|---|---|---|---|
| 4238951 | 8/1992 | Japan | 256/59 |

*Primary Examiner*—Harry C. Kim

*Attorney, Agent, or Firm*—Kenneth Watov, Esq.; Watov & Kipnes, P.C.

[57] ABSTRACT

A rail section assembly having a vertically directed plurality of spindles, each having an open hollow cavity at opposing first and second ends, a plurality of retaining members or brackets, each one of the brackets having at least one vertically projecting stud configured to snugly fit into the open end cavities of a corresponding spindle. An equal number of brackets are coupled successively together end-to-end for forming top and bottom rails of equal length, respectively. The spindles are rigidly secured at associated ends between and to the studs of opposing top and bottom brackets for forming a rail section.

14 Claims, 11 Drawing Sheets

METHOD AND APPARATUS FOR FORMING RAILING SECTIONS

FIELD OF THE INVENTION

The present invention relates generally to railing construction, and more particularly to rail sections utilizing the minimal variety of prefabricated components.

BACKGROUND OF THE INVENTION

Rails have several uses such as securing a deck. Typically, rails comprise a horizontally extending bottom rail and a parallel top rail spaced from the bottom rail, with a plurality of spindles or other vertical elements extending between the top and bottom rails, spaced from each other, and rigidly connected to the top and bottom rails at their respective ends.

Railing construction has presented many problems including difficulty in the economic manufacture and assembly of parts. Where railing systems are put together with screws and bolts, a considerable amount of labor may be required to construct each rail section. The parts needed to assemble many of today's rails, especially those made of metal or plastic, are often numerous and difficult to manufacture. Another problem a rail installer often faces, is the separation of walls or end posts varying from the design dimension by as much as several inches. Because of the variations in separation, precut modular railings often underwent extensive on-site alterations at the time of installation, and therefore their use was limited. Railings which were cut to size, assembled, and installed on-site required a great amount of labor, and often lacked uniformity with other nearby installations.

Accordingly, there is a need for an improved rail structure, preferably using plastic components, wherein the rail utilizes the minimal number of parts, can be easily assembled with minimal waste, is of low cost, and is handsome and durable in use.

SUMMARY OF THE INVENTION

With the problems in the prior art in mind, one object of the present invention is to provide an improved rail section assembly including the use of the minimal number of parts which can be easily assembled to provide a rail section of desired length.

It is a further object of this invention to provide an improved rail assembly without the need for specific fastening devices to allow easy and rapid assembly.

It is a further object of this invention to provide the user with a rail assembly that requires little instruction, a minimal number of tools, and is cost effective to construct.

It is a further object of this invention to provide a rail assembly that is structurally strong, cheap to make, easy to assemble, durable and lasting, and aesthetically pleasing to the eye.

It is a further object of this invention to provide a modular rail section construction which is flexible to varying span lengths, thereby minimizing waste of prefabricated construction materials during installation.

With these and other objects in mind, the present invention includes a plurality of vertically oriented spindles each having a top and a bottom end, with each end being configured to have a hollow cavity extending there into. A top interior rail and a bottom interior rail are each formed from a plurality of successively interlocking and abutting individual brackets. Each individual bracket possesses at least one vertically projecting stud that is configured to snugly fit into the top and bottom end cavities of the plurality of spindles. The studs of the top interior rail are coupled to the corresponding top end cavities of the plurality of spindles. The studs of the bottom interior rail are coupled to the corresponding bottom end cavities of the plurality of spindles. The brackets and spindles are held together in a rigid manner by fastening means, such as a plastic glue or cement when plastic components are used to form the rail sections.

BRIEF DESCRIPTION OF THE DRAWINGS

The various embodiments of the invention are described in detail below with reference to the drawings, in which like items are identified by the same reference designation, wherein.

DETAILED DESCRIPTION OF THE INVENTION

Figure 1:
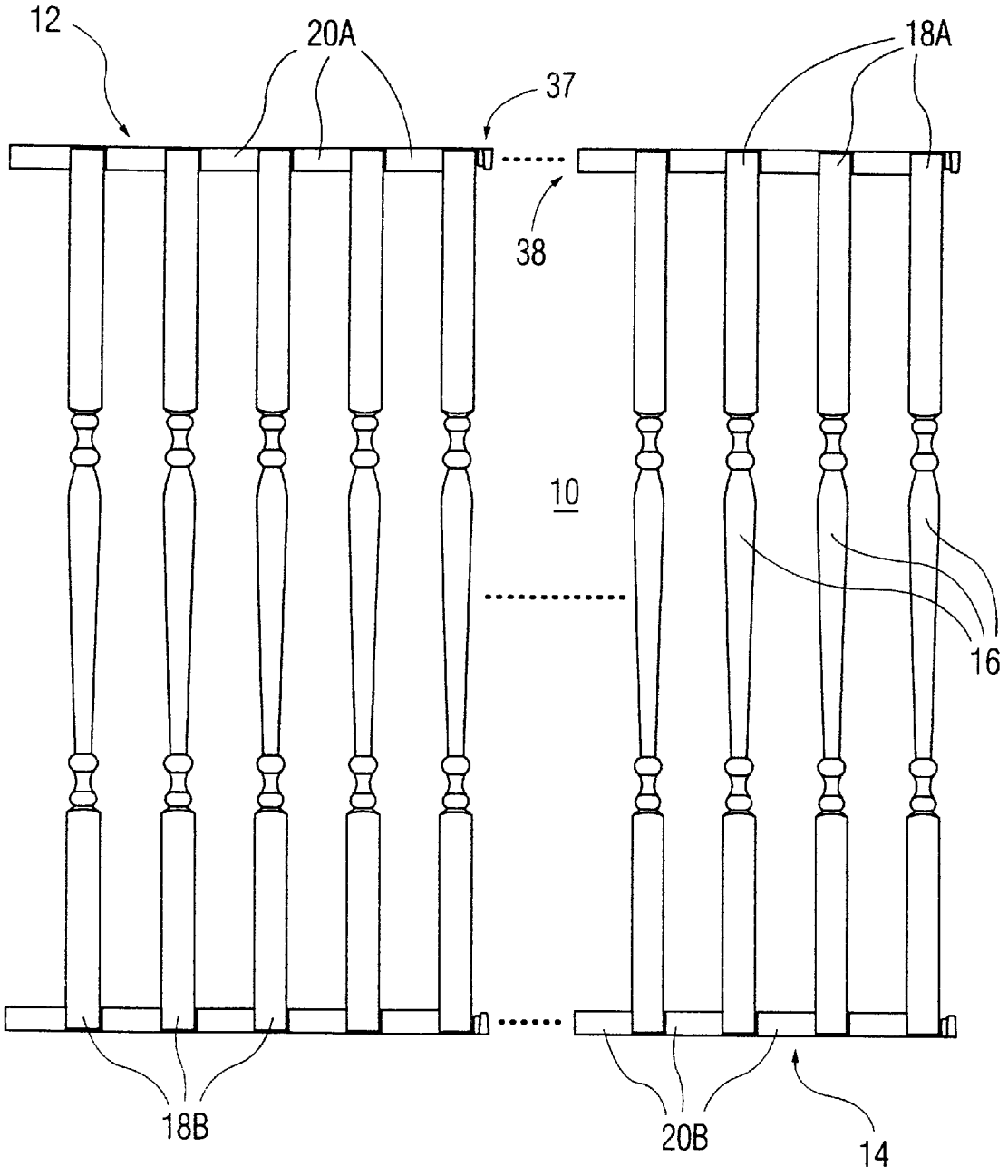
FIG. 1 a front elevation view illustrating a prefabricated rail section according a preferred embodiment of the invention.

With reference to the drawings, and more particularly FIG. 1, a rail section assembly 10 in accordance with the principles of the present invention is shown. The embodiment depicted in FIG. 1 illustrates a completed rail section with the elements securely coupled. In this embodiment, the assembly 10 comprises a horizontally extending top interior rail 12, and a parallel bottom interior rail 14 spaced from the top interior rail 12. A plurality of vertically oriented spindles 16 extends between the top and bottom interior rails 12, 14, spaced from each other, and connected to the top and bottom interior rails 12, 14 at their respective ends.

Figure 2B:
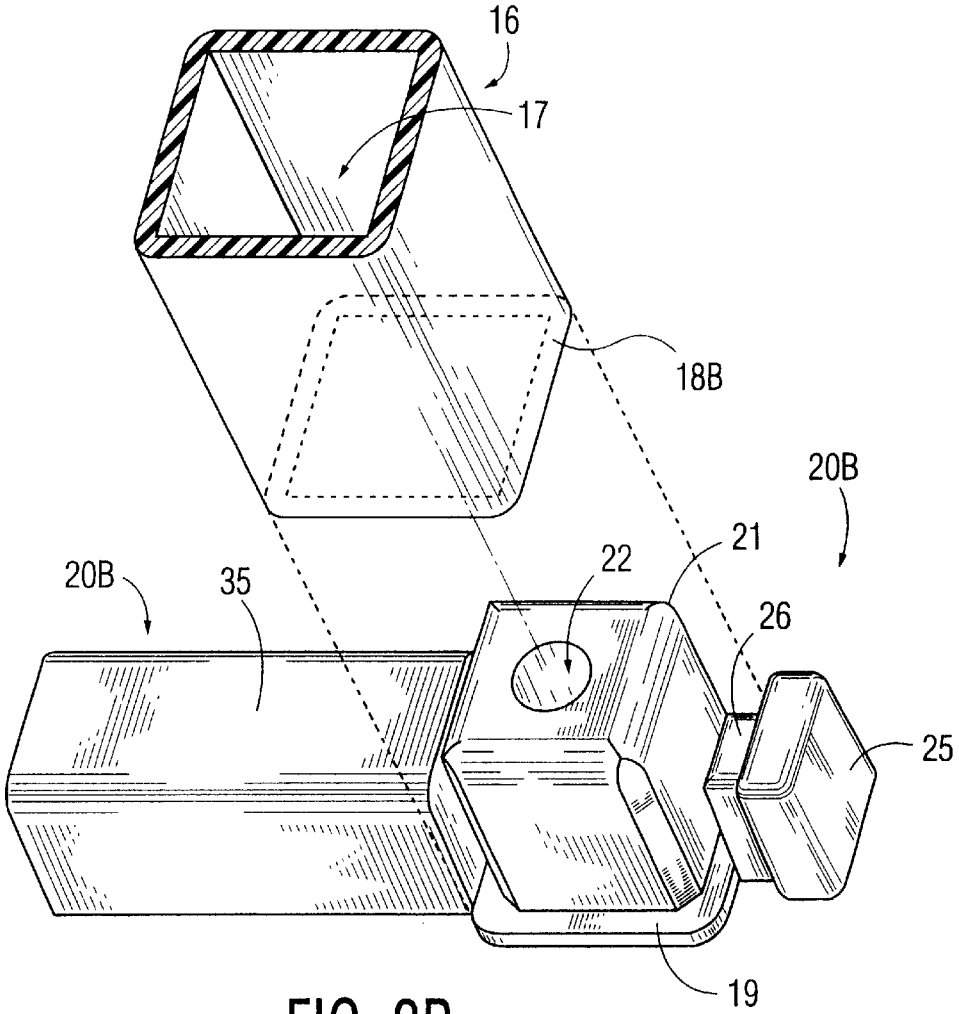
FIG. 2B is a partial pictorial exploded assembly view and cross section of a spindle end in position to couple with or receive a vertically projecting stud of a bottom bracket for an embodiment of the invention.
Figure 2A:
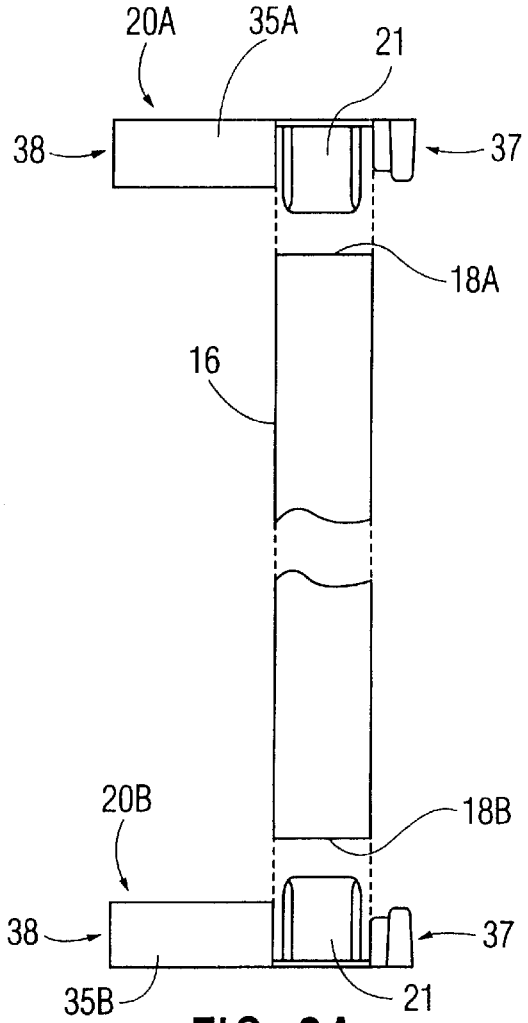
FIG. 2A is an exploded assembly view of a unit of a rail section depicting a vertically directed spindle and the opposing brackets positioned for coupling to each associated end of a spindle, for one embodiment of the invention.

Both the top and bottom interior rails 12, 14 are made up of successively interlocking and abutting retaining members, or respectively, top and bottom brackets 20A, 20B. As shown in FIG. 2A, each bracket 20A, 20B possesses a male end 37 and a female end 38 each configured to couple with another bracket 20 at each associated end 37, 38 to form a chain-like structure. This chain of retaining members forms the basis of the top and bottom interior rails 12, 14. The bracket-by-bracket construction of the top and bottom interior rails 12, 14 allows for easy attainment of a desired length of the span, thereby minimizing waste of excess rail materials. Each bracket 20A, 20B is also configured to couple with the end 18A, 18B, respectively, of a spindle 16 as shown in FIG. 2B. This permits the top and bottom interior rails 12, 14 to be attached to the top and bottom ends 18A, 18B, respectively, of the plurality of spindles 16. A securing means such as an appropriate glue, or screws, for example, is utilized to rigidly and securely retain the brackets 20A, 20B and spindles 16 together. The prefabricated components as described can be made out of any suitable material (i.e. wood, metal, plastic) available for rail construction. The simple design of this rail section assembly 10 and its component parts provides a low cost, aesthetically pleasing, and easy to manufacture and assemble system of rail construction. In a preferred embodiment, the components are fabricated from plastic extrusions. It should be noted that the components are not to be limited to extruded plastic, but can include other material such as molded plastic and so forth. In another embodiment, the components are formed preferably by a plastic composite of a desired color or painted by a user to desired color.

In FIG. 2A, the basic unit of the rail section assembly 10 is shown. The top portion of the top bracket 20A and the bottom bracket 20B are facing each other with an associated spindle 16 therebetween. An exploded perspective assembly view of a spindle 16 positioned to be installed onto a bracket 20B is shown in FIG. 2B. The spindle end 18 has a open cavity 17 therein configured to snugly fit on the vertically projecting stud 21 all the way down to the base 19 of the bracket 20B. The coupling of the stud 21 to the spindle end 18 may be secured by various means available in railing construction such as nails, screws, welding, retaining pins, and others. In this embodiment, the parts are made of a plastic polymer material and are held together by plastic cement or any adhesive material suitable for bonding plastic parts.

Figure 3A:
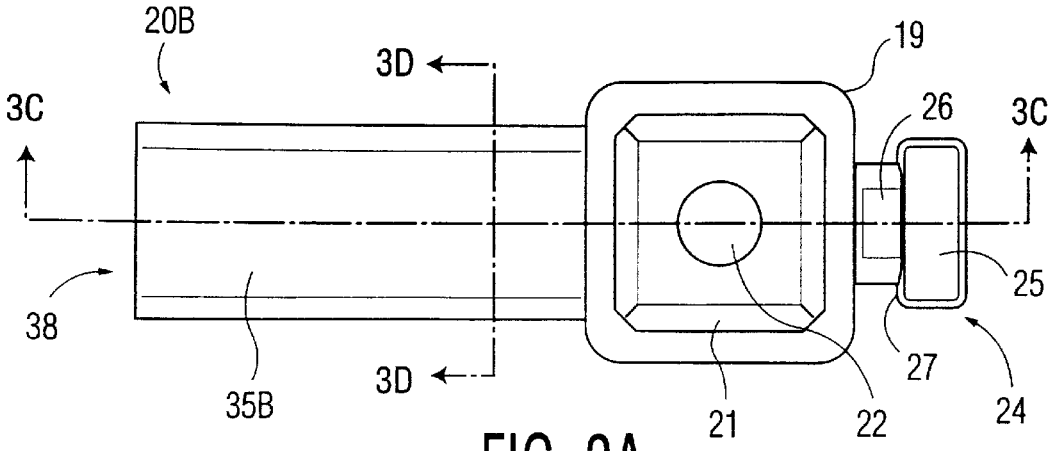
FIG. 3A is a top plan view of a bottom bracket for one embodiment of the invention.
Figure 3B:
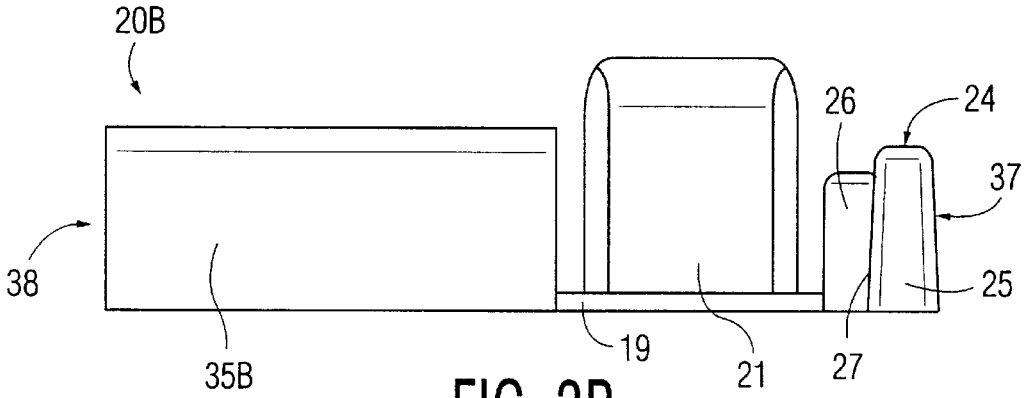
FIG. 3B is a side elevational view of the bottom bracket of FIG. 3A.

FIG. 3A is a top view of a bottom bracket 20B which is the basic unit of the bottom interior rail 14. The spacing section 35B proximate one end 38 of the bracket 20B functions to properly space the spindles 16 a fixed distance from one another in the rail section 10. The spacing section 35B also houses a female locking finger 31 (shown in FIG. 3C) proximate the end 38. Proximate the other end 37, the bracket 20B includes a vertically projecting stud 21 that is configured to snugly fit into an associated end cavity 17 of a spindle 16, as previously described. Juxtaposed to the stud 21 at the extreme end is a male coupling member 24 that is configured to snugly fit with the female coupling structure 30 of another bracket 20B. In this embodiment, the stud 21 includes a through hole 22 that is configured to snugly fit and retain an attaching member for anchoring the rail section 10 to a base substrate such as a wood or concrete deck or a floor, for example. FIG. 3B is a side view of a bracket 20B further illustrating the spacing section 35B, the vertically projecting stud 21, and the male coupling member 24.

Figure 3C:
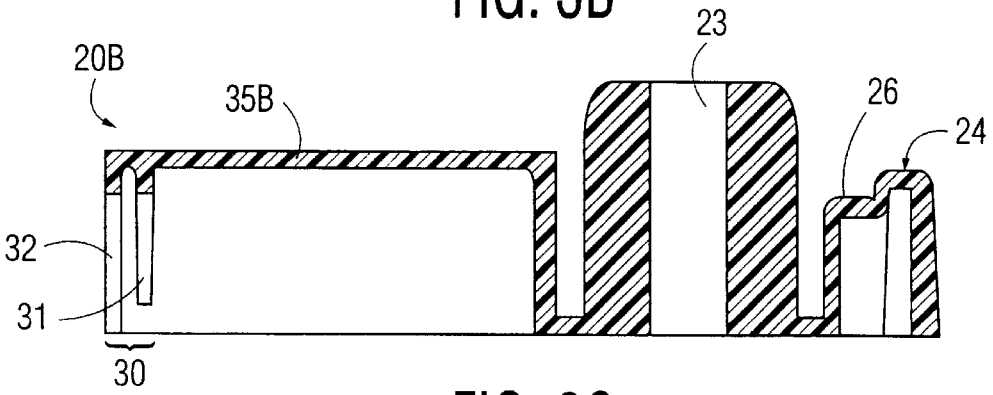
FIG. 3C is a cross sectional view taken along 3C—3C of the bottom bracket of FIG. 3A.
Figure 3D:
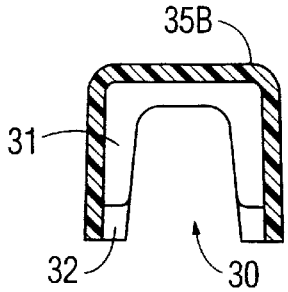
FIG. 3D is a cross sectional view taken along 3D—3D of the bottom bracket of FIG. 3A.

FIG. 3C shows a cross sectional side view of a bottom bracket 20B taken along 3C—3C of FIG. 3A. The interior female locking finger 31 is located within the spacing section 35B at the end portion 38. The through hole 22 extends through the stud 21 from the top to the bottom. The cavity 23 is configured to receive an elongated fastening device used to anchor the rail section assembly 10 directly to a wood or concrete deck or a floor, for example. FIG. 3D is a cross sectional view of the bottom bracket 20B taken along 3D—3D of FIG. 3A illustrating the female coupling structure 30. The finger structure 31 resides within the spacing section 35B. Both the exterior slot 32 at the end 38 of bracket 20B, and the finger structure 31 are configured to snugly fit over the neck 26 of the male coupling member 24.

Figure 4:
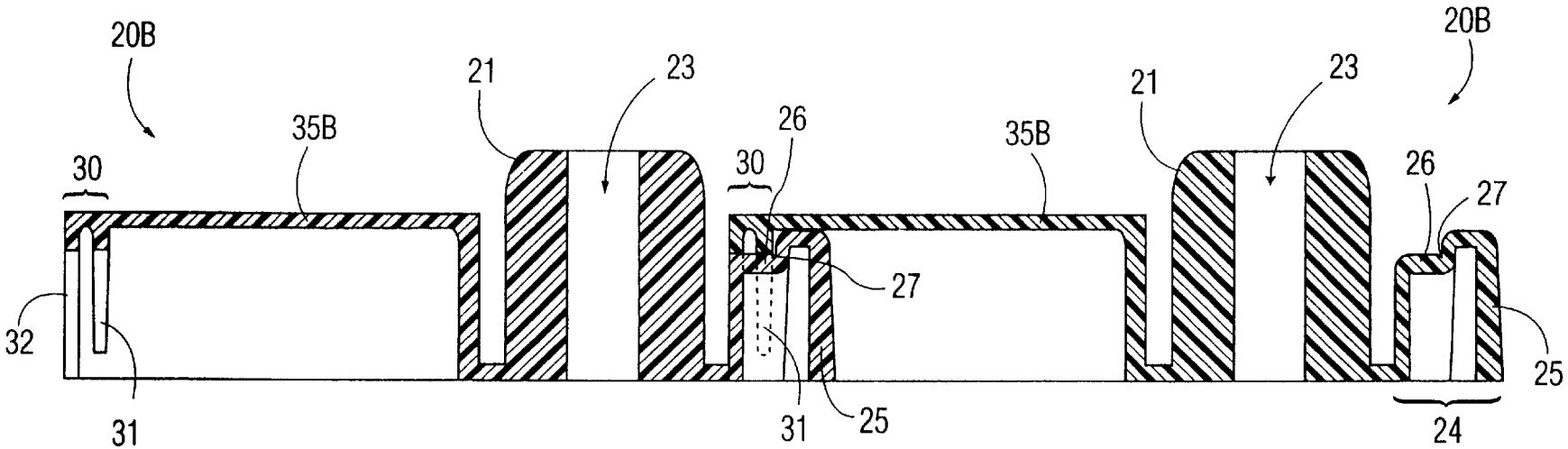
FIG. 4 is a longitudinal cental cross sectional side elevational view of two brackets coupled at their respective ends for one embodiment of the invention.

FIG. 4 provides is a longitudinal cross sectional side view of two bottom brackets 20B abuttingly coupled together as shown. The female coupling structure 30 fits over the neck 26 of the male coupling member 24 with the interlocking finger 31 contacting the interior side 27 of the head 25 of the male coupling member 24. Additional brackets 20B are linked successively in this manner to form the bottom interior rail 14. The length of the rail 14 is determined by the number of brackets 20B linked together. The top interior rail 12 is constructed in the same manner using top brackets 20A.

Figure 5:
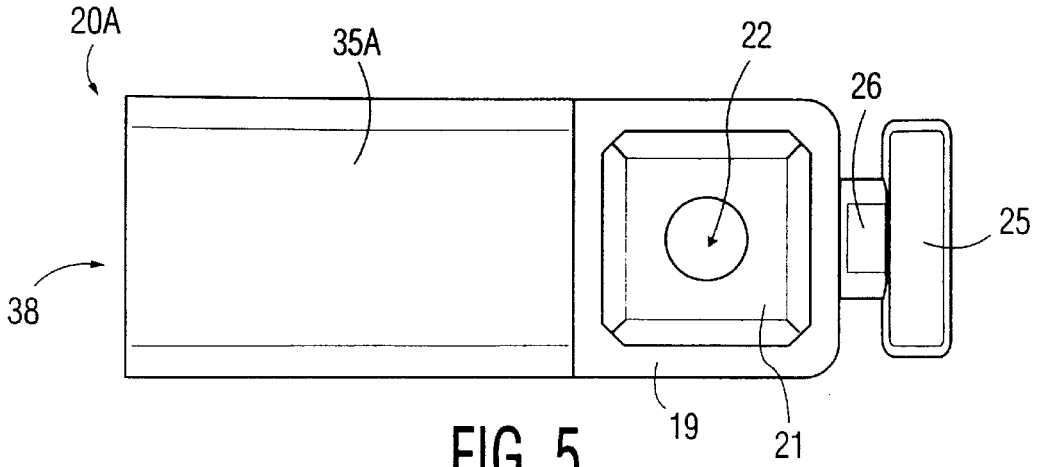
FIG. 5 is a top plan view of a bracket forming part of the top interior railing, for another embodiment of the invention.
Figure 6:
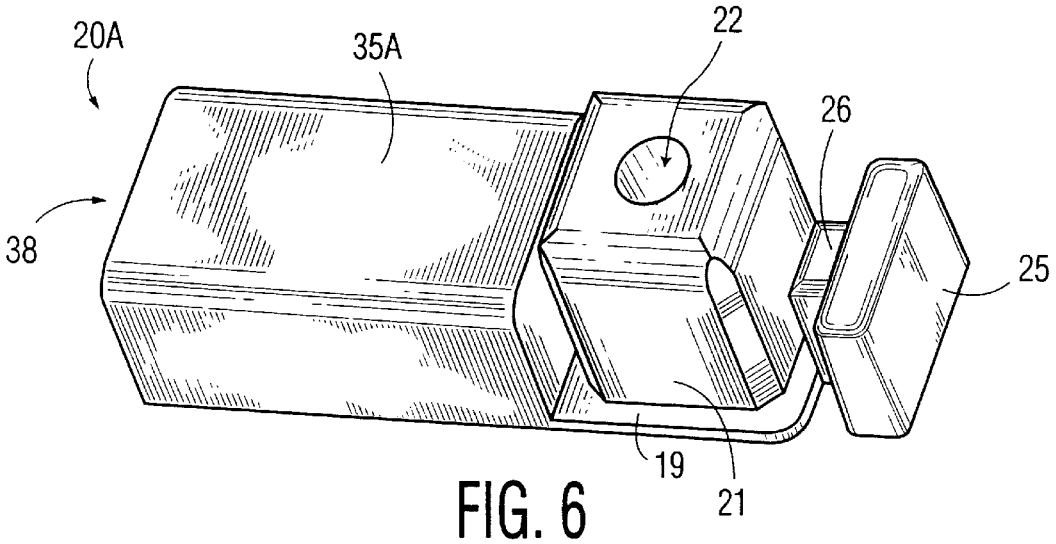
FIG. 6 is a perspective view looking at the side and the top of the bracket of FIG. 5.
Figure 7:
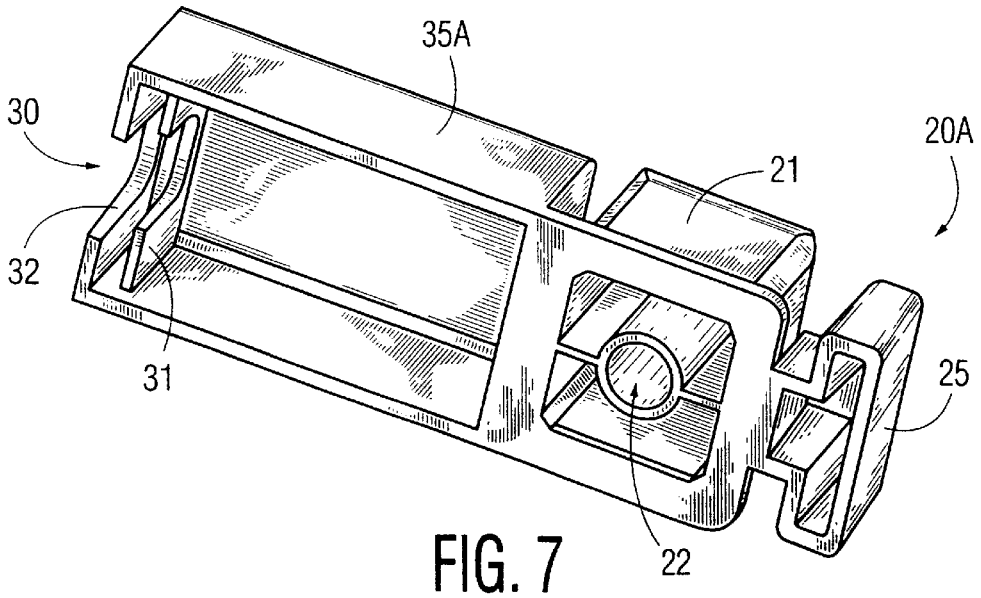
FIG. 7 shows a perspective view from the bottom and side of the bracket of FIG. 5.

FIGS. 5, 6, and 7 show top plan, top pictorial, and bottom pictorial views, respectively, of a top bracket 20A. The basic configuration of this bracket 20A is exactly the same as the previously discussed bottom bracket 20B. The only difference between the top bracket 20A and the bottom bracket 20B is the width of the spacing sections 35A, 35B. The top bracket's spacing section 35A is wider than that of the bottom bracket's spacing section 35B. There is no functional basis for the difference. It is based solely on aesthetics. The two types of brackets 20A, 20B function in the same manner and purpose. Therefore, the discussion above on the construction of the bottom interior rail 14 applies equally to the top interior rail 12 using the top brackets 20A.

Figure 8:
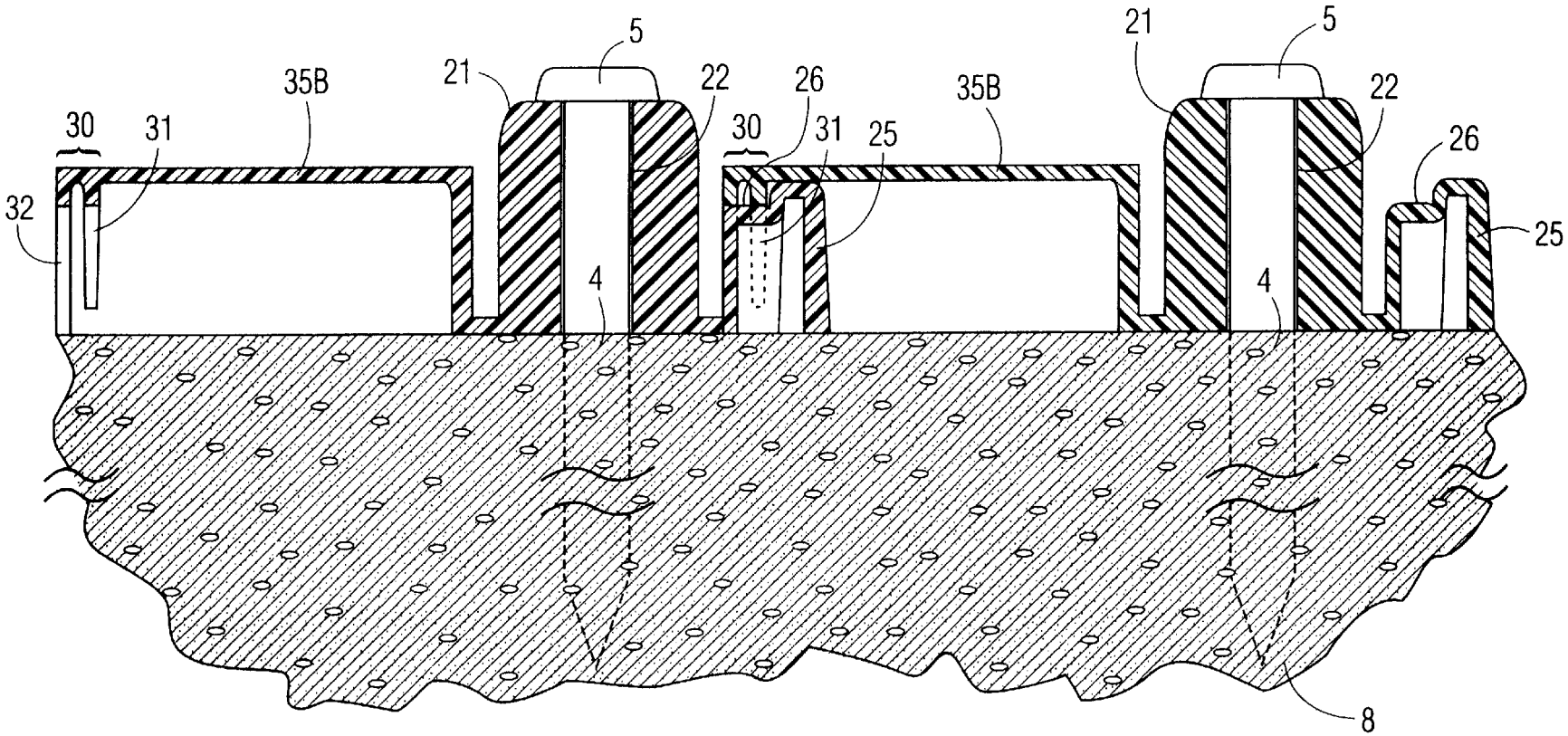
FIG. 8 is a cross sectional side elevational view of two coupled bottom brackets anchored to a concrete deck by stakes adapted for use in concrete substrate, for an embodiment of the invention.
Figure 9:
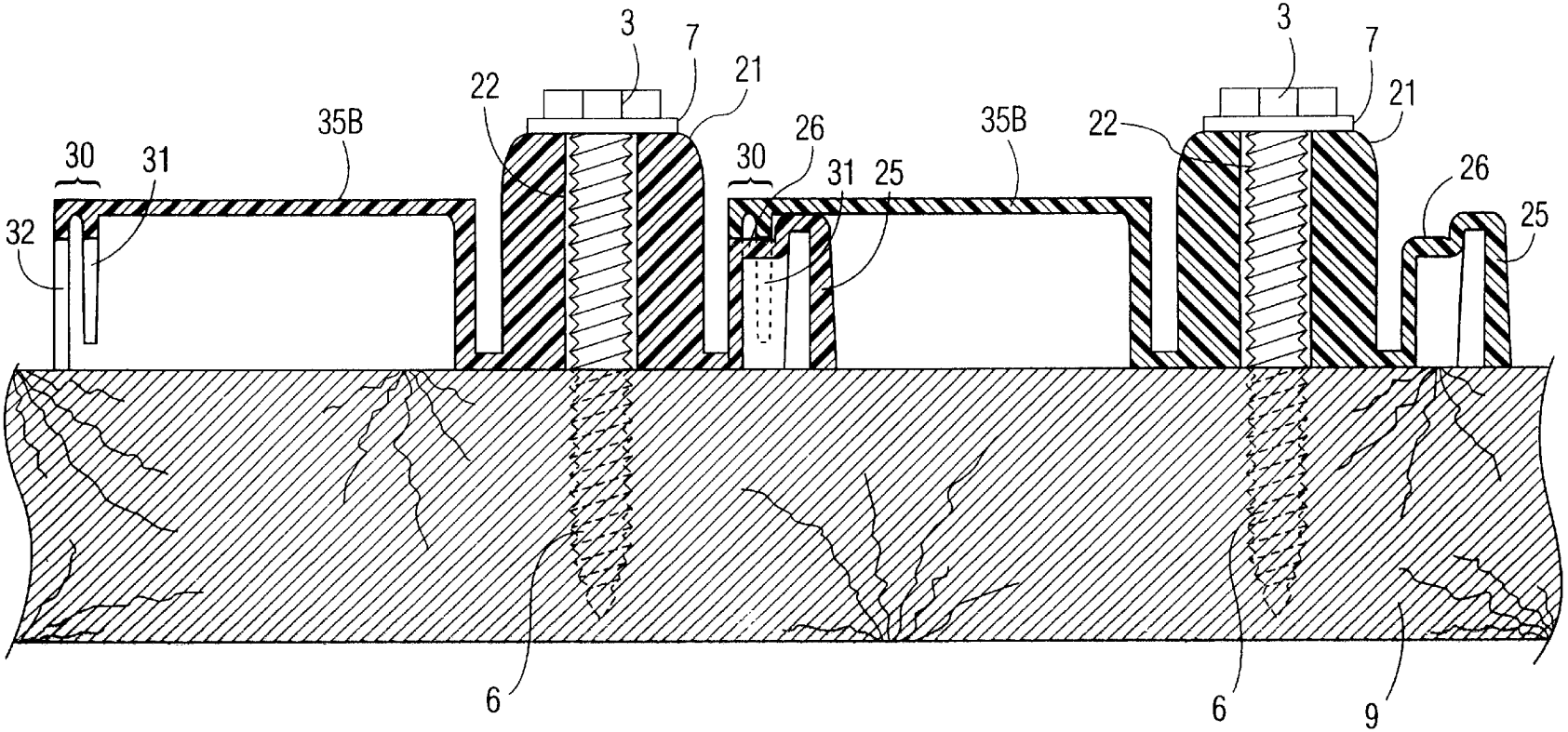
FIG. 9 is a cross sectional side elevational view of two coupled bottom brackets anchored to a wood deck by screws and washers, for an embodiment of the invention.

Upon assembly of the bottom interior rail 14, the rail 14 may be anchored or fixed to a rail post using conventional methods and means in railing construction. Alternatively, the bottom interior rail assembly 14 may also be anchored directly to a concrete deck 8. This can be accomplished by driving a stake 4 adapted for use in concrete material through each through hole 22 into the concrete deck 8 beneath as shown in FIG. 8, for example. The head 5 of the stake 4 must not be so wide such that its edge interferes with the proper fitting between the spindle end 18 and the stud 21. Alternatively, the bottom interior rail assembly 14 may be anchored to a wood deck 9 by means of screws 6 and washers 7 as shown in FIG. 9, for example. The screwhead 3 and the washer 7 combination must reside within the bounds of the top of the stud 21 to allow a proper fit between the spindle end 18 and the stud 21.

Figure 10A:
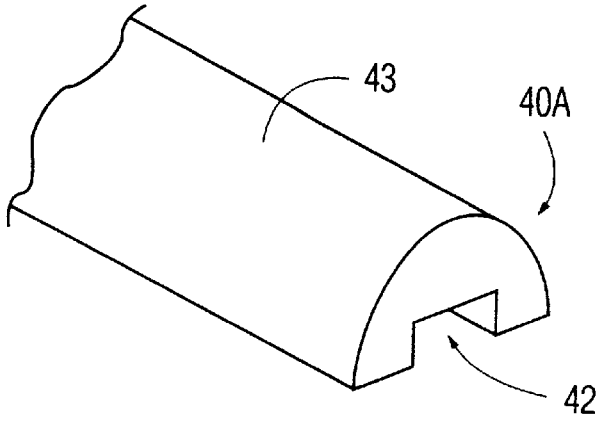
FIG. 10A shows a perspective view of a top rail cap for an embodiment of the invention.
Figure 10B:
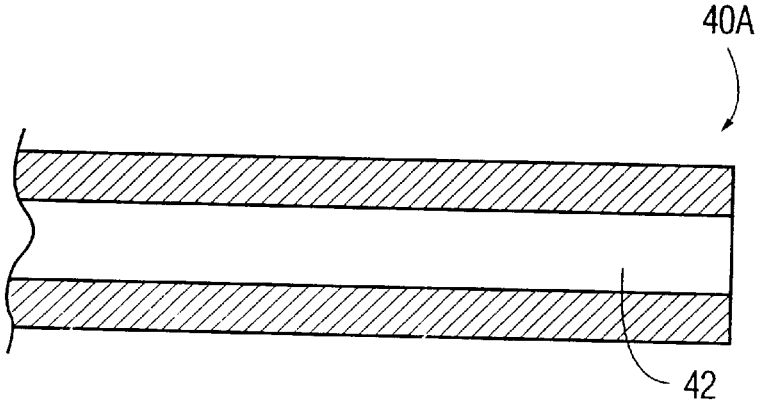
FIG. 10B is a bottom plan view of the top rail cap of FIG. 10A.
Figure 10C:
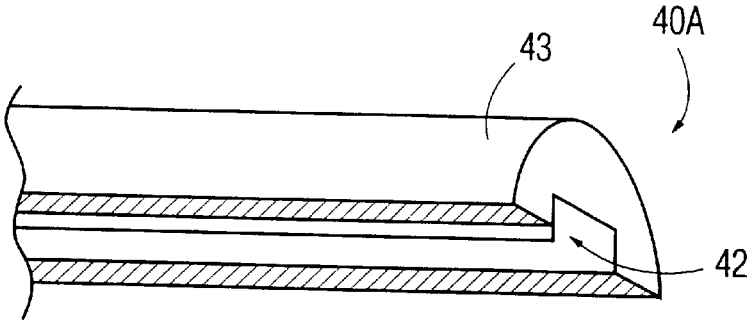
FIG. 10C shows a perspective view from the bottom of a top rail cap for an embodiment of the invention.
Figure 11A:
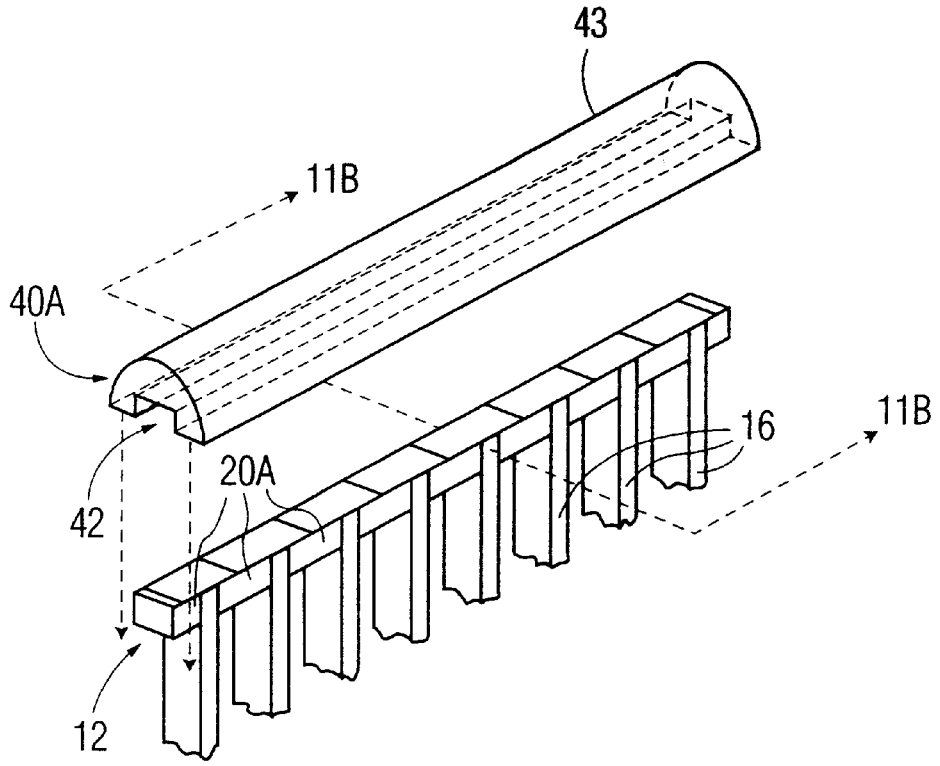
FIG. 11A is an exploded assembly view of a top rail cap positioned for installation on a rail section assembly of the invention.
Figure 11B:
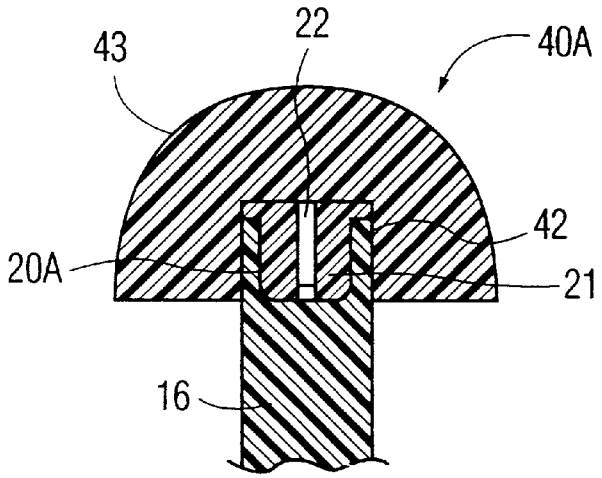
FIG. 11B is cross sectional view taken along 11B—11B of FIG. 11A of a top rail cap coupled to a rail section assembly.

Upon mounting the top and bottom interior rails 12, 14 to the corresponding top and bottom ends 18A, 18B, respectively, of the vertically directed plurality of spindles 16, an optional top and bottom rail cap 40A, 40B, may be installed upon the respective top and bottom interior rails 12, 14. The top rail cap 40A (shown in FIG. 10A) has a rounded exterior surface 43 extending along its length and includes a squared off U-shaped channel 42 running along a central portion of its bottom. The channel 42 can also best be seen in FIGS. 10B and 10C showing the bottom plan, and bottom pictorial views, respectively. The channel 42 is configured to retain the bottom portions of the successively abutting individual brackets 20A of the top interior rail 12. The top rail cap 40A is installed on top of the interior rail assembly 12 and couples flush with the bracket components 20A (shown in FIGS. 11A and 11B). In this embodiment, a plastic cement or adhesive is used to fix the plastic top rail cap 40A to the plastic top interior rail 12 of the plastic rail section assembly 10. The top rail cap 40A provides the rail section assembly 10 an aesthetically pleasing look, adding rigidity to the structure, and a surface 43 for a person to rest upon or hold.

Figure 12A:
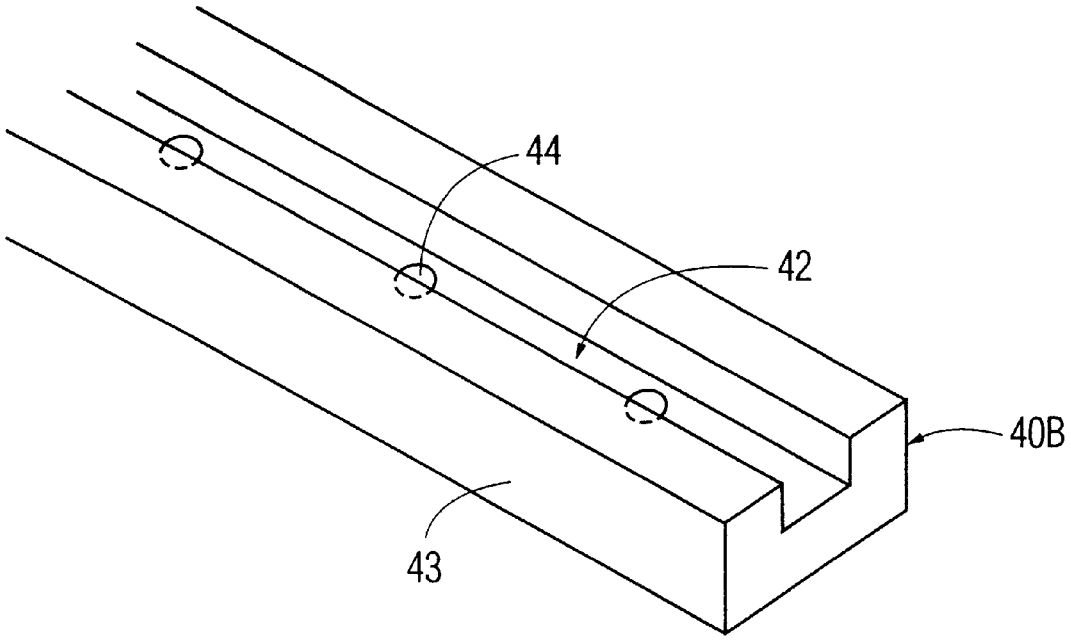
FIG. 12A is a perspective view of a bottom rail cap for an embodiment of the invention.
Figure 12B:
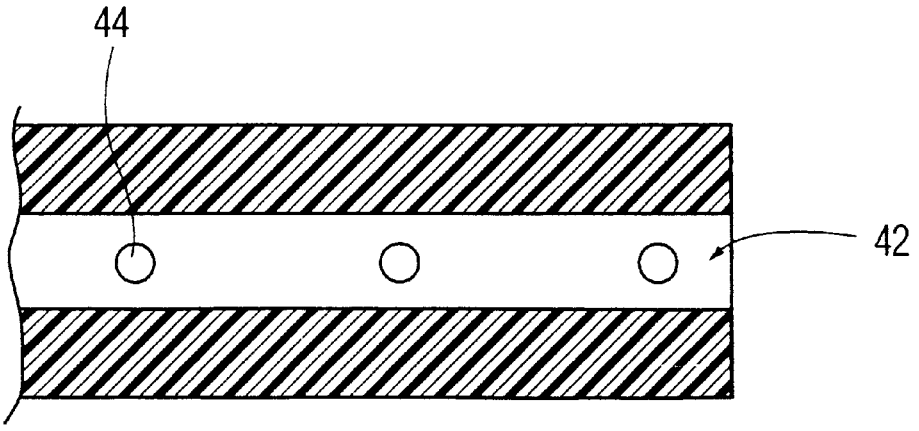
FIG. 12B is a top plan view of the bottom rail cap of FIG. 12A.

The bottom rail cap 40B (see FIG. 12A) is structurally equivalent to the top rail cap 40A. The only differences are that the channel 42 of the bottom rail cap 40B is upward facing, the cap 40B installs onto the bottom interior rail 14, and the exterior surface 43 of cap 40B is squared along the length (see FIGS. 12A and 12B). The bottom rail cap 40B is typically installed on the bottom interior rail assembly 14 when the latter is spaced away from its mounting surface. In another embodiment, the cap 40B may be coupled to a bottom interior rail 14 that is to be anchored directly to the deck or floor. It would then be necessary for the anchoring member (i.e. stakes, bolts, screws) to penetrate the cap 40B for proper anchoring.

Figure 13A:
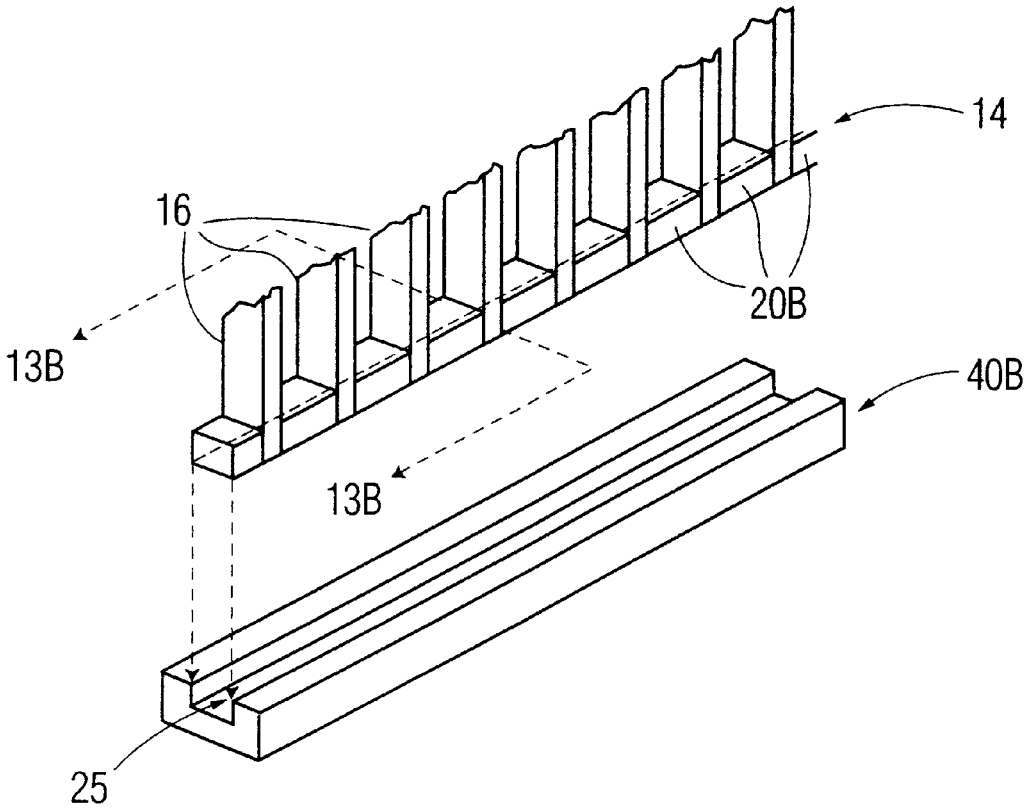
FIG. 13A is an exploded assembly view of a bottom rail cap positioned for installation on a bottom interior rail of the rail section assembly for an embodiment of the invention.
Figure 13B:
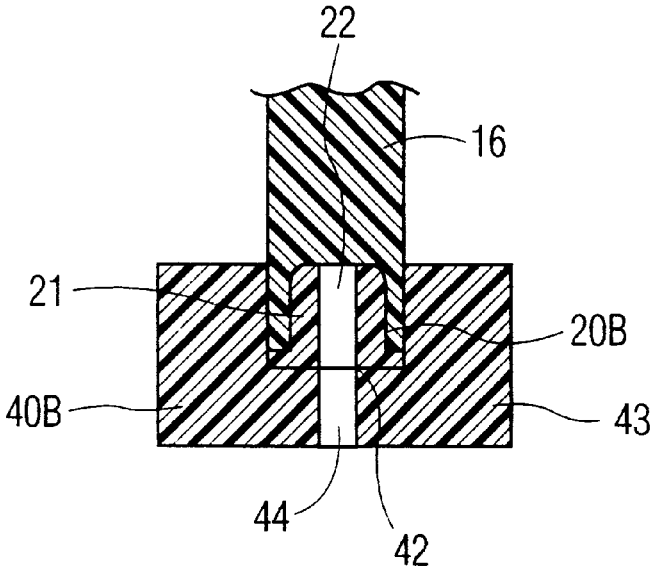
FIG. 13B is a cross sectional view taken along 13B—13B of FIG. 13A of the bottom rail cap coupled to the interior rail of the rail section assembly.

The bottom rail cap 40B with its channel 42 facing up is secured to the bottom interior rail 14 in essentially the same manner as the top rail cap 40A to the top interior rail 12. The bottom portions of the successively abutting individual brackets 20B of the bottom interior rail 14 are inserted into the channel 42 of the cap 40B, and are typically flush with the brackets 20B (see FIGS. 13A and 13B). The bottom rail cap 40B, like the top rail cap 40A, serves the purpose of providing an aesthetically pleasing look to the rail section assembly 10, according the structure added rigidity, and protecting the bottom interior rail 14 from the onslaughts of errant feet or low-lying objects.

To match the length of the rail section assembly, the exterior caps 40A, 401 may be cut to length, and secured to the upper and lower rails 12, 14, respectively, by adhesives or other securing means. For components made of a plastic polymer material, a plastic cement or appropriate adhesive is used to bond the exterior rail caps 40A, 40B to the rail section assembly 10. Again, it should be recognized that the top and bottom rail caps 40A, 40B are optional and the rail section assembly 10 is functionally complete without these components.

In one embodiment of the invention, the rail section assembly 10 is constructed by first securing together a desired number of bottom brackets 20B, and a desired number of top brackets 20A, for obtaining top and bottom interior rails 12, 14 of desired length. The spindles 16 have their bottom ends 18B installed onto an associated protruding stud 21 of individual bottom brackets 20B. The basic rail section 10 is completed by installing the top interior rail 12 by coupling the studs 21 of the individual top brackets 20A to the associated top ends 18A of the spindles 16, as previously described. If desired, a top rail cap 40A, and/or a bottom rail cap 40B, can be installed onto the top interior rail 12 and the bottom interior rail 14, respectively. As previously discussed through use of plastic components, an appropriate adhesive can be used to securely and rigidly hold together the rail components.

Although various embodiments of the invention have been shown and described, they are not meant to be limiting. Those of skill in the art may recognize various modifications to these embodiments, which modifications are meant to be covered by the spirit and scope of the appended claims.

What is claimed is:

1. A railing system, comprising:

a plurality of spindles each having a hollow cavity at opposing first and second ends thereof, respectively;

a plurality of retaining members, each of said plurality of retaining members including:

at least one vertically projecting stud configured to snugly fit within either one of the cavities of the first and second ends of said plurality of spindles;

a first and a second end;

a first coupling member located proximate said first end;

a second coupling member located on said second end;

said first coupling member being configured to enter and snugly fit into a corresponding second coupling member of a first retaining member, and said second coupling member being configured to receive and retain a corresponding first coupling member of a second retaining member; and means for securing together a plurality of said retaining members and spindles.

2. The system of claim 1, wherein:

said vertically projecting studs, each having an anchor support shaft vertically running along the center of its length; and said anchor support shaft being configured to receive and retain anchor means for rigidly securing the associated retaining member to a surface upon which the associated rail is to be mounted.

3. The system of claim 1, further including a top rail cap, and a bottom rail cap, each having an open channel for receiving the bottom portion of successively abutting individual ones of said retaining members.

4. The system of claim 3, wherein an adhesive material is used to rigidly retain said spindles, said retaining members, said top rail cap, and bottom rail cap together.

5. The system of claim 3, wherein said top rail cap is roundly shaped along its top length, and said bottom rail cap is squarely shaped along its top and bottom length.

6. A rail assembly system, comprising:

a plurality of individual spindles each having first and second ends, each end being configured to have a hollow cavity extending into the associated first and second ends;

a plurality of individual retaining members, each including at least one vertically projecting stud configured to receive and fit within either one of a first or second end of one of said plurality of spindles; and a top rail cap, and a bottom rail cap, each having an open channel for receiving a bottom portion of individual ones of said retaining members for securing the same together in spaced apart relationship with associated spindles therebetween for forming an elongated section of a rail.

7. The system of claim 6, wherein:

said vertically projecting studs, each having an anchor support shaft vertically running along the center of its length; and said anchor support shaft being configured to receive and retain anchor means for rigidly securing the associated retaining member to a surface upon which the associated rail is to be mounted.

8. The system of claim 6, wherein said retaining members each include:

a first and a second end;

a first coupling member located proximate said first end;

a second coupling member located on said second end; and said first coupling member being configured to enter and snugly fit into a corresponding second coupling member of a first retaining member, and said second coupling member being configured to receive and retain a corresponding first coupling member of a second retaining member.

9. The system of claim 6, wherein an adhesive material is used to rigidly retain said spindles, said retaining members, said top rail cap, and bottom rail cap together.

10. The system of claim 6, wherein said spindles, retaining members, and top and bottom rail caps are made of a material selected from the group consisting of wood, plastic and metal.

11. A method for assembling a rail section including a plurality of brackets each having a first section serving as a spacing section with one end including interior female locking fingers, and the other end including a vertically projecting stud having a through hole vertically running along center of its length, juxtaposed to a male coupling member at another end of said bracket, and a plurality of spindles each having a hollow cavity formed within opposing ends and configured for snugly fitting onto a protruding stud of individual one of said plurality of brackets, said method comprising the steps of:

interconnecting successive ones of said plurality of brackets together by coupling the female locking fingers of one bracket to the male coupling member of an adjacent bracket to form a top and a bottom interior rail members of said rail system, respectively;

interconnecting the ends of successive individual ones of said plurality of spindles onto the studs of vertically opposing ones of said plurality of brackets of said top and bottom interior rails;

rigidly securing said spindles to said brackets; and rigidly securing together the brackets of said top and bottom interior rails.

12. The method of claim 11, wherein said brackets, said spindles consists of plastic polymer material, said method further comprising the steps of:

securing said brackets of said top and bottom interior rails together using adhesive material between the male-female coupling members of said interconnected brackets during assembly; and securing said spindles to associated studs of said brackets using adhesives therebetween.

13. The method of claim 11, further including the step of:

securing said plurality of brackets forming said bottom interior rail to a floor via a plurality of attaching members, each entering the through holes of said vertically projecting studs of said plurality of brackets, and into the floor, respectively.

14. The method of claim 11, further including the step of:

securing said plurality of brackets forming said bottom interior rail to wooden or concrete deck via a plurality of attaching members, each entering the through holes of said vertically projecting studs of said plurality of brackets, and into the deck, respectively.

* * * * *